United States Patent [19]

Colamussi et al.

[11] 4,103,496

[45] Aug. 1, 1978

[54] COLLAPSIBLE AND EXPANSIBLE BARRAGE

[75] Inventors: Arturo Colamussi; Vittorio Merli, both of Ferrara, Italy

[73] Assignee: Pirelli Furlanis - Applicazioni Idrauliche Agricole Gomma S.p.A., Milan, Italy

[21] Appl. No.: 786,558

[22] Filed: Apr. 11, 1977

[30] Foreign Application Priority Data

Apr. 15, 1976 [IT] Italy ..... 9004 A/76
Dec. 30, 1976 [IT] Italy ..... 30986 A/76

[51] Int. Cl.[2] ..... E02B 7/40
[52] U.S. Cl. ..... 61/27; 61/25
[58] Field of Search ..... 61/25, 26, 27, 23, 22, 61/30, 29, 22 A, 1, 7, 8

[56] References Cited

U.S. PATENT DOCUMENTS

| | | | |
|---|---|---|---|
| 495,788 | 4/1893 | Debarle | 61/26 |
| 735,387 | 8/1903 | Irwin | 61/26 |
| 1,040,112 | 10/1912 | Ashford et al. | 61/27 |
| 1,841,747 | 1/1932 | Lun | 61/27 |
| 3,069,861 | 12/1962 | Berke et al. | 61/22 A |

FOREIGN PATENT DOCUMENTS

| | | | |
|---|---|---|---|
| 106,890 | 1875 | France | 61/25 |
| 967,354 | 8/1964 | United Kingdom | 61/26 |
| 1,389,370 | 4/1975 | United Kingdom | 61/26 |

*Primary Examiner*—Jacob Shapiro
*Attorney, Agent, or Firm*—Stevens, Davis, Miller & Mosher

[57] ABSTRACT

A collapsible and expansible barrage comprising a threshold structure disposed at the bottom of the waterway, a metallic flap, provided with an upturned-glass type of air-tank, hinged to said threshold structure, and a flexible sheet connected at one of its end to the threshold structure and to the other end to the threshold structure; the flap and the threshold structure are further connected one to the other by means of a damped tie-rod.

10 Claims, 6 Drawing Figures

COLLAPSIBLE AND EXPANSIBLE BARRAGE

The present invention concerns a collapsible and expansible barrage, and in particular it refers to a collapsible and expansible barrage of the type which comprises a metallic flap and a flexible sheet of material, both fixed down to a threshold structure disposed at the bottom of the waterway which is to be dammed up. The waterway can regardlessly be either a river, an arm of the sea, a lagoon, or the like.

Barrages of the type in question are already known. The known barrages provide: an air-tank in correspondence of the metallic flap for rendering this flap inherently buoyant, so as to allow for the stowing of the entire flexible sheet of material inside a hollow recess of the threshold structure, and means disposed in the threshold structure for the purpose of feeding and draining the water inside the closed space defined by the threshold structure, the metallic flap, and the flexible sheet of material, in order to carry out the operations of collapsing and expanding the barrage.

The known barrages, described above, present numerous drawbacks. The presence of a single closed air-tank inside the metallic flap is unable to guarantee, either now or as time passes, the inherent buoyancy of the flap itself; as a consequence, there is no guarantee, as time passes, for the efficient functioning of the barrage — especially during the collapsing operation, without risking the integrity of the flexible sheet, and hence the said barrage itself.

Besides this, the known barrages are not stable, in the sense that under stresses due to wave movements, they undergo oscillations which submit the flexible sheet to very heavy tension and to fatigue stresses, risking the integrity of the barrage as well as its efficient functioning.

The aim of a barrage, according to the present invention, is to accomplish a barrage which functions surely, even when faced with any eventual damages owing to the presence of bodies in the waterway to be dammed — such as boats, floating tree-trunks, and the like, either when in its expanded state, or when it is in its collapsed state.

A further aim of this present invention is to provide stability to the shape of the barrage when in its expanded condition, even after is has undergone the action of bumps and of stresses which it can be subjected to, as for example, under the action of a flood-wave, if localized in a river, or an undulating motion which is present in the waterway if this happens to be, for example, a stretch of sea, or the opening inlet of a lagoon leading out to the sea or to a river, in such a way as to allow the barrage, when in an expanded state, to act as a rigid barrage i.e. to act just as a rigid conventional barrage.

The object of the present invention is a collapsible and expansible barrage comprising a threshold structure on the bottom of the waterway to be dammed, provided with a hollow recess for housing the barrage itself in its collapsed state, a metallic flap, provided with an air-tank, hinged along one of its borders to the threshold structure, a flexible sheet such as a rubberized fabric fixed, by one of its borders, to the metallic flap, and with its other border fixed down to the threshold structure, means being provided in the threshold structure for admitting and extracting water into the closed space defined by the threshold structure, the metallic flap, and the flexible sheet, characterized by the fact that the air-tank is an upturned-glass type of air-tank, and by the fact that it comprises means provided on the threshold structure for admitting pressurized air into the closed space defined by the threshold structure, the metallic flap, and the flexible sheet, and at least one tie rod connecting the threshold structure to the metallic flap.

The present invention will be better understood from the following detailed description referred to some embodiments given by way of non-limiting example, with reference to the figures in the attached drawing sheets, where:

Figure 1:
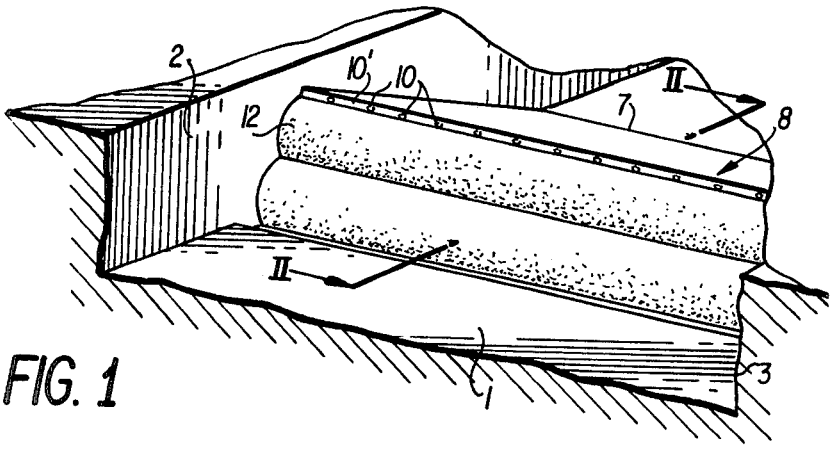
FIG. 1 shows a perspective view of a part of a barrage according to the present invention.

In FIG. 1, there is represented a barrage according to the present invention, should the case be of placing the barrage in a canal.

As may be seen in FIG. 1, the canal comprises a bottom 1, and two banks 2 and 3, perpendicular to the said bottom 1.

On the bottom 1, (see also FIG. 2), there is set a threshold structure 4, in for example, reinforced concrete, which constitutes the threshold structure of the barrage according to the invention, and inside this threshold structure 4 there is present a hollow recess 5.

Figure 3:
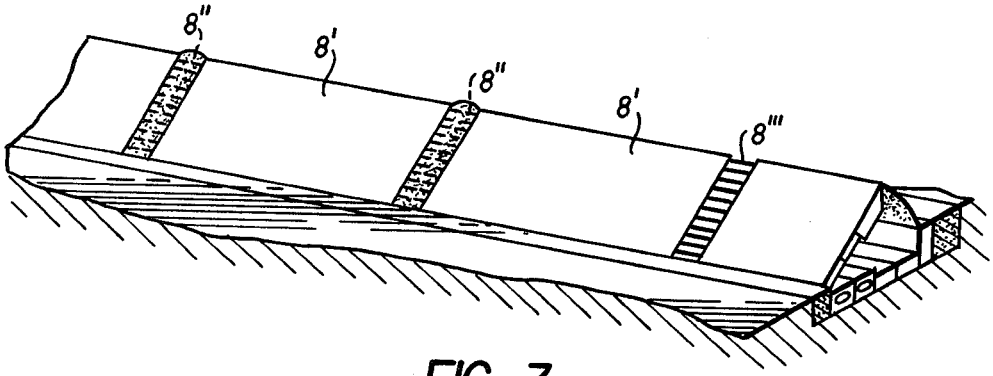
FIG. 3 shows a perspective view of a part of the barrage according to the present invention in an alternate embodiment.

On the edge 6 of the threshold structure 4, there is hinged at 7, a metallic flap 8 constituted by, as shown in FIG. 1, a single plate 8' of metallic material, or — according to an alternative embodiment, as shown in FIG. 3, of several plates of metallic material 8', each one of which is provided with an upturned-glass type of air-tank, placed one behind the other, and connected one to the other by lengths of rubberized fabric 8'', and by lengths of chains or tie rods 8'''.

To the metallic flap 8 is associated at least one upturned-glass type of air-tank 9, constituted by at least one casing, provided with a series of valves 10, actionable from the outside, and placed in correspondence of, or close to the edge 10' of the metallic flap 8 so as to regulate the quantity of air within the upturned-glass type of air-tank, and consequently, to vary in this way the thrust of buoyancy of the latter.

In correspondence of the edge 10' in the metallic flap 8, there is fixed the end 11, of a flexible sheet 12, for example, of rubberized fabric, the other end 13 of which is fixed to the threshold structure 4 in correspondence of the edge 14 of the latter.

In this way, between the threshold structure 4, the metallic flap 8, and the flexible sheet 12 there forms a closed hollow space 15.

The metallic flap 8, is besides this, connected to the threshold structure 4 by means of at least one flexible tie-rod consisting preferably of a material having a low specific weight, and in practice, of a plurality of flexible tie-rods 16, for example ropes, the function of which will be described further on.

In particular, each tie-rod 16, is provided at least at one of its extremities, with a damping element; in particular, even though this is not to be understood in a limiting sense, the damping element is foreseen in the position where the tie-rod 16 is connected to the metallic flap 8.

Figure 4:
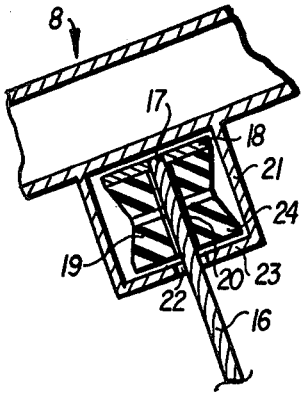
FIG. 4 shows a large-scale cross-section of a detail of FIG. 2.

In FIG. 4 is shown in large-scale, the details of the system which joins the tie-rod 16 to the metallic flap 8, through the means of a damping element.

As can be seen in FIG. 4, the extremity 17, of the tie-rod 16, is rigidly fixed to a metallic slab 18, which leans on one face of a body 19 of elastomeric material, provided with a cavity 20, through which the tie-rod 16 passes. The elastomeric material body 19 is housed in a box 21, departing in cantilever fashion from the walls of the metallic flap 8 towards the closed hollow space 15.

The box 21 has an aperture 22 on the face 23 inside which lies the face 24 of the elastomeric material body 19, and through said aperture 22 passes the tie-rod 16.

Always on the inside of the closed hollow space 15 (see FIG. 2) is present at least another flexible tie-rod 25, and in practice a plurality of flexible tie-rods 25, such as, for example, metallic chains which are connected at one end, to the threshold structure 4, near to the edge 6 of the latter, and at the other end, connected to a rigid profile 26, fixed to the flexible sheet 12 along a line parallel to said threshold structure.

In the threshold structure 4, there are present besides this, a pair of conduits 27 and 28, for admitting water and pressurized air respectively, into the closed hollow space 15. For this purpose, the conduit 27 communicates with a plurality of apertures 29, and the conduit 28 communicates with a plurality of nozzles 30.

Besides this, still on the threshold structure 4, there is present a plurality of supports 31, on which the metallic flap 8 rests when the barrage is collapsed, and there are foreseen a plurality of elastomeric material bodies 32, in correspondence of the edge 14 of the threshold structure on which the end 10' of the metallic flap 8 rests when the barrage is collapsed.

Figure 5:
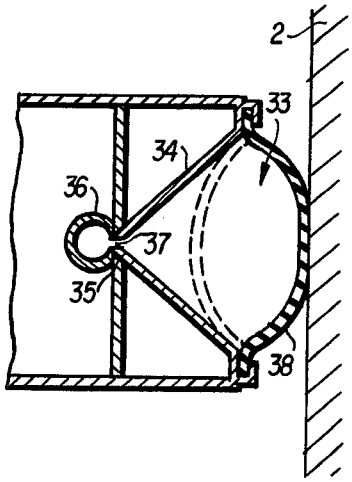
FIG. 5 shows a large-scale cross-section of a sealing system of the barrage against the banks of the waterway, in correspondence of the metallic flap.
Figure 6:
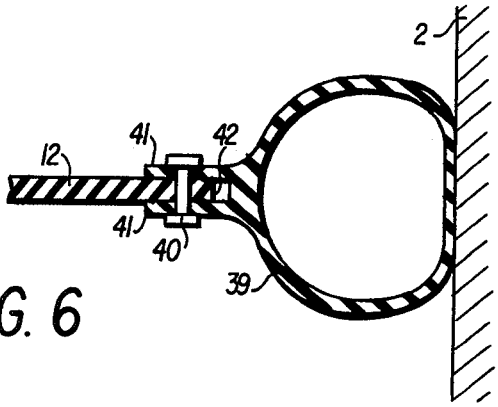
FIG. 6 shows a large-scale cross-section of the sealing system of the barrage against the banks of the waterway, in correspondence of the flexible sheet.

On the edges of the barrage, where it comes into contact with the canal banks 2 and 3, there are foreseen sealing means, and these sealing means are shown in FIGS. 5 and 6. As can be seen in FIGS. 5 and 6, in correspondence with both the edges of the metallic flap, and with the edges of the flexible sheet where these come into contact with the canal banks 2 and 3, there are foreseen small casings which can be deflated or expanded.

In particular, in FIG. 5, there is an expansible and deflatable casing 33, foreseen in correspondence of the edges of the metallic flap 8 which faces the canal banks 2 and 3.

As can be seen in FIG. 5, the metallic flap 8 foreseen the fixing — for example by welding, to its end which faces for example the canal bank 2, an L-shaped profile 34, which, in correspondence of the vertex 35, holds a tube 36 which is provided with holes 37 in its own wall, and in the profile wall. At both the L-shaped profile 34 ends, there are fixed the extremities of a tape 38 in a flexible material, so that when inside the closed space defined by the profile 34 and the tape 38 — that is, in the casing 33, a depression is caused, the tape 38 assumes the form shown by the dotted-line, and it is not in contact with the bank 2.

In FIG. 6 is shown the expansible and deflatable casing 39, foreseen in correspondence of the edges of the flexible sheet which faces the canal banks 2 and 3.

As can be seen in FIG. 6, the flexible sheet 12 holds fixed down by bolts 40, a tubular inflatable and deflatable body (constituting the casing 39) departing from which abut two fins 41, which define between them, a U-shaped space 42, into which is inserted the edge of said flexible sheet 12.

The tubular body constituting the casing 39, has been provided with inlet and outlet conduits for pressurized fluid (not visible in FIG. 6) by means of which conduits it is possible to distend the casing 39 so that one part of it adheres to the canal bank 2 (or 3) or — by deflating it, said casing 39 becomes detached from the said canal bank 2 (or 3).

The operation of the barrage, according to the present invention, beginning from the collapsed state of the barrage, is as follows.

Figure 2:
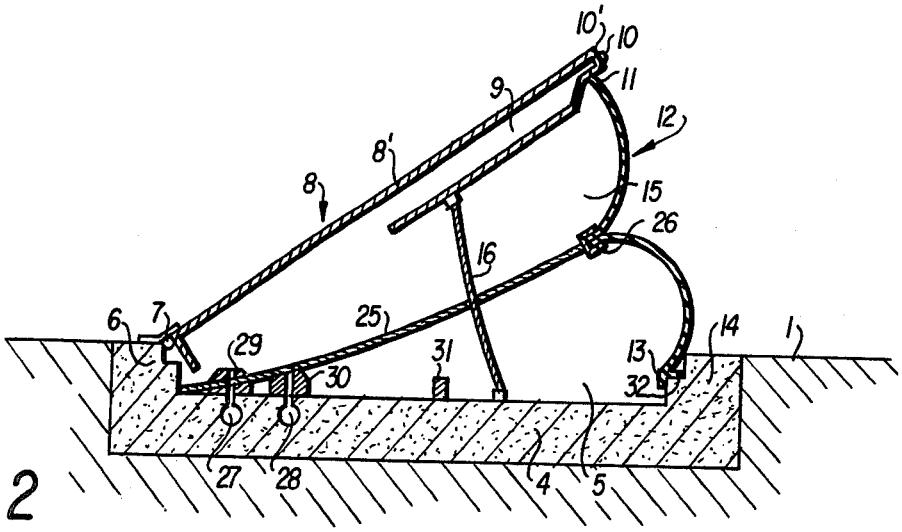
FIG. 2 shows a cross-section of a barrage according to the present invention taken along the line II—II of FIG. 1.

Though conduits 27 and 28, water and pressurized air are admitted into the closed hollow space 15, and in this way the barrage assumes the conformation which is represented in FIG. 2.

The admission of water and of pressurized air continues, until the two series of tie-rods 16 and 25 are put under tension.

In particular, the pressurized air, bubbling in the water which is present in the closed space 15, passes on, to occupy the upturned-glass type of air-tank, and the water fills the remaining space.

When the barrage has reached the state of maximum expansion, the casings 33 and 39, existing in correspondence of the respective metallic flap and the flexible sheet in contact with the canal banks 1 and 2, are enlarged.

In this state, which is shown in FIGS. 1 and 2, the barrage according to the present invention, acts as a rigid barrage, no matter from whichsoever direction the strain occurs.

As a matter of fact, under the action of the strain due, for example, to a wave during its positive phase, the metallic flap is prevented from approaching the threshold structure by the pressure of water in the closed space 15; and during the negative phase of said wave, the metallic flap is prevented from moving away from the threshold structure due to the presence of the series of tie-rods 16; finally, the flap substantially maintains its own position, and hence, any variations in the volume and configuration of the barrage, are prevented.

Besides this, the presence of the two series of tie-rods 16 and 25 minimize the stresses in the flexible sheet 12; as a matter of fact, the tie-rods 25 reduce the amplitudes of free inflexions of said flexible sheet 12 and the tie-rods 16 absorb the traction stresses which, except for the presence of these, would have had to be absorbed by the said flexible sheet 12.

Eventually, the presence of the upturned-glass type of air-tanks, each provided with an air vent-hole, and with conduits for admitting said air into the threshold structure should said air-tank be damaged due to a collision against any foreign body present in the waterway as, for example, floating tree-trunks, boats, or the like, ensures that the operation of the barrage is still guaranteed as, even though the air should escape from the point of the damage as well as from the air vent-hole, the barrage would still be in a position to work, since this would simply be a matter of increasing the amount of the said air.

The operation of the barrage, according to the present invention for collapsing it, is as follows.

First of all, the deflation of the casings 33 and 39, is effected by creating a depression inside them, thus causing the walls of said casings to become detached from the canal banks 2 and 3.

At this point, by means of conduit 27, the water inside the closed space 15 is drawn away. Once the water is drawn away from the closed space 15, the metallic flap 8 rotating on its hinge 6, approaches the threshold structure 4, the tie-rods 25 which, as said before, consist of preferably metallic chains — i.e. heavy bodies which slowly settle to the bottom, dragging with them the flexible sheet 12, for stowing it away in the closed hollow recess.

Besides this, from the moment when, with the drawing away of the water from the closed hollow space 15, there is created inside this space a lower pressure to what is found outside the threshold structure, the stowing of the flexible sheet in the space of said threshold structure, is quite absolutely ensured.

With the approaching of the metallic flap 8 to the threshold structure 4, we also have the housing inside the latter, of the tie-rods 16, which consist preferably of a rope having a structure, which when the tie-rods 16 are not under tension, assumes a spiral configuration.

On termination of the operation for drawing away water from the closed space 15, the metallic flap 8 shows its end 10 to be resting on the threshold structure in correspondence to the elastomeric material bodies 32.

Although a particular embodiment for the barrage, according to our invention, has been illustrated and described here, it is understood that this invention includes in its scope any other possible alternative embodiments available to a technician of this field. In particular, it is understood, that within the scope of the present invention, is also included the solution according to which the flexible sheet is provided with rigid profiles, one parallel to the other, and consequently, a plurality of a series of tie-rods, and the solution according to which in the damped tie-rods, the damping element could be constituted by a particular conformation of the tie-rod itself.

We claim:

1. A collapsible and expansible barrage, comprising:

a threshold structure on the bottom of a waterway to be dammed-up, provided with a hollow recess for housing the barrage itself in its collapsible state a metallic flap provided with an air-tank, open along its side that is turned towards the threshold structure, when the barrage is in its expanded state, said metallic flap being hinged along one of its own edges to the threshold structure a flexible sheet fixed by one of its borders to the metallic flap, and with its other border fixed down to the threshold structure means being housed in the threshold structure, for extracting and admitting water under pressure in the enclosed space defined by the threshold structure, the metallic flap, and the flexible sheet means being housed in the threshold structure for admitting air into the air-tank by means of the air-tank opening that is turned towards the threshold structure at least one flexible member provided with at least one damping element, connecting the threshold structure with the metallic flap whereby the configuration of the barrage in its expanded state is non-modifiable by strain and fatigue stresses in the flexible sheet.

2. A barrage, according to claim 1, characterized by the fact that the flexible member is inextensible.

3. A barrage according to claim 1, characterized by the fact that the flexible member is a rope, in a material having a high resistance to tractions, fixed by its own extremity to the threshold structure, and by its other end to the metallic flap, a damping element being disposed at least at one extremity of the tie-rod.

4. A barrage, according to claim 1, characterized by the fact that it comprises a rigid profile fixed to the flexible sheet at a line parallel to the threshold structure, and at least one connecting flexible member joined by one of its own ends to said profile, and by its other end to the threshold structure.

5. A barrage, according to claim 4, characterized by the fact that the said flexible member, joined to the profile and to the threshold structure, is a metallic chain.

6. A barrage, according to claim 1, characterized by the fact that on the borders of the upturned air-tank, there are valves for escape of air.

7. A barrage, according to claim 1, characterized by the fact that the metallic flap, hinged to the threshold structure, is constituted by a plurality of metallic plates, each one equipped with an upturned air-tank, hinged side-by-side to each other, and joined one to the other by a length of rubberized fabric, and by length of chains.

8. The barrage of claim 1, characterized by the fact that sealing means are in correspondence of the banks of the waterway, said sealing means comprising an inflated chamber in correspondence of the sides of the metallic flap facing the banks and to the borders of the flexible sheet which faces the said banks.

9. A barrage, according to claim 1, characterized by the fact that on the threshold structure there is at least one intermediate support for the metallic flap, when the barrage is in its collapsed state.

10. A barrage for raising the water level of a waterway upstream thereof comprising a base member disposed on the bottom of the waterway and having a surface facing the water, a flap member comprising a metallic plate member hinged at one edge to the base member which extends at least partially across the waterway and is inclined upwardly from the hinge point to the surface of the water, said plate member being inclined towards upstream, a flexible sheet member attached at one of its edges to the base member and at its opposite edge to the plate member at its edge opposite from the hinge point, at least one flexible rope-like member attached at one end to the plate member and its opposite end to the base, said flexible sheet joining with the flap member and base member to close the space between the plate member and base member, said base member having a recess in its said facing surface adapted to receive said plate member when it lies against the base member.

* * * * *